US008967300B2

(12) United States Patent
Dewey et al.

(10) Patent No.: US 8,967,300 B2
(45) Date of Patent: Mar. 3, 2015

(54) PRESSURE ACTIVATED FLOW SWITCH FOR A DOWNHOLE TOOL

(75) Inventors: Charles H Dewey, Houston, TX (US); John E. Campbell, Houston, TX (US); Daniel LeVon, Golden, CO (US)

(73) Assignee: Smith International, Inc., Houston, TX (US)

( * ) Notice: Subject to any disclaimer, the term of this patent is extended or adjusted under 35 U.S.C. 154(b) by 213 days.

(21) Appl. No.: 13/345,400

(22) Filed: Jan. 6, 2012

(65) Prior Publication Data

US 2013/0175095 A1 Jul. 11, 2013

(51) Int. Cl.
*E21B 10/32* (2006.01)

(52) U.S. Cl.
USPC ..... 175/269; 175/267; 175/274; 175/284; 175/291; 166/321; 166/332.1; 166/383

(58) Field of Classification Search
USPC ..... 166/321, 319, 332.1, 241.6, 373, 383, 166/120; 175/269, 265, 267, 281, 274, 284, 175/291, 230, 73, 74
See application file for complete search history.

(56) References Cited

U.S. PATENT DOCUMENTS

| | | | | |
|---|---|---|---|---|
| 3,224,507 | A | 12/1965 | Cordary | |
| 3,425,500 | A | 2/1969 | Fuchs | |
| 4,055,226 | A | 10/1977 | Weber | |
| 4,466,336 | A * | 8/1984 | Broome et al. | 91/420 |
| 4,491,187 | A | 1/1985 | Russell | |
| 4,714,116 | A | 12/1987 | Brunner | |
| 5,139,098 | A | 8/1992 | Blake | |
| 5,318,137 | A | 6/1994 | Johnson et al. | |
| 5,318,138 | A | 6/1994 | Dewey et al. | |
| 5,332,048 | A | 7/1994 | Underwood | |
| 5,443,129 | A | 8/1995 | Bailey | |
| 5,518,073 | A | 5/1996 | Manke et al. | |
| 6,289,911 | B1 | 9/2001 | Majkovic | |
| 6,289,999 | B1 | 9/2001 | Dewey et al. | |
| 6,732,817 | B2 | 5/2004 | Dewey et al. | |
| 7,281,584 | B2 | 10/2007 | McGarian | |
| 7,445,059 | B1 | 11/2008 | Falgout | |
| 7,493,971 | B2 | 2/2009 | Nevlud et al. | |
| 7,506,703 | B2 | 3/2009 | Campbell | |
| 7,513,318 | B2 | 4/2009 | Underwood | |
| 7,597,158 | B2 | 10/2009 | Campbell | |
| 2003/0111267 | A1 | 6/2003 | Pia | |

(Continued)

FOREIGN PATENT DOCUMENTS

| | | |
|---|---|---|
| GB | 2305681 | 4/1997 |
| WO | 2007144719 | 12/2007 |

OTHER PUBLICATIONS

International Search Report and Written Opinion of PCT Application No. PCT/US2013/020405 dated Apr. 29, 2013: pp. 1-14.

*Primary Examiner* — David Andrews
*Assistant Examiner* — Taras P Bemko

(57) ABSTRACT

A downhole tool includes a pressure activated flow switch for selectively actuating and deactuating a device, such as a reaming block. The flow switch is deployed external to the flow bore and includes a flow piston configured to reciprocate between axially opposed open and closed positions such that the device is actuated when the flow piston is in the open position and deactuated when the flow piston is in the closed position. The flow piston is configured to translate from the closed position to the open position when a differential pressure exceeds a predetermined threshold. The flow piston may be further configured to remain in the open position at differential pressures less than the threshold.

6 Claims, 6 Drawing Sheets

(56) References Cited

U.S. PATENT DOCUMENTS

| | | | | |
|---|---|---|---|---|
| 2003/0146023 | A1 | 8/2003 | Pia | |
| 2003/0217850 | A1 | 11/2003 | Shaw et al. | |
| 2004/0134689 | A1 | 7/2004 | Fujii | |
| 2007/0089912 | A1 | 4/2007 | Eddison | |
| 2007/0095573 | A1 | 5/2007 | Telfer | |
| 2007/0102163 | A1 | 5/2007 | Heath | |
| 2008/0110678 | A1 | 5/2008 | Radford | |
| 2008/0128175 | A1 | 6/2008 | Radford | |
| 2008/0245574 | A1 * | 10/2008 | Campbell et al. | 175/57 |
| 2009/0032308 | A1 | 2/2009 | Eddison | |
| 2010/0089583 | A1 | 4/2010 | Xu et al. | |
| 2011/0284233 | A1 | 11/2011 | Wu | |

* cited by examiner

PRESSURE ACTIVATED FLOW SWITCH FOR A DOWNHOLE TOOL

BACKGROUND

Downhole drilling operations commonly require a downhole tool to be actuated after the tool has been deployed in the borehole. For example, underreamers are commonly tripped into the borehole in a collapsed state (i.e., with the cutting structures retracted into the underreamer tool body). At some desired depth (or location), the underreamer is actuated such that the cutting structures expand radially outward from the tool body thereby engaging the borehole wall. Hydraulic actuation mechanisms are well known in oilfield services operations and are commonly employed, and even desirable, in such operations.

For example, one well-known hydraulic actuation methodology involves wireline retrieval of a plug (or "dart") through the interior of the drill string to create differential pressure to actuate an underreamer. Upon completion of the reaming operation, the underreamer may be deactuated by redeploying the dart. While commercially serviceable, such wireline actuation and deactuation mechanisms are both expensive and time-consuming in that they require concurrent use of wireline or slick line assemblies.

Another commonly used hydraulic actuation methodology makes use of shear pins designed to shear at or above a specific differential pressure (or in a predetermined range of pressures). Ball drop mechanisms are also known in the art, in which a ball is dropped down through the drill string to a ball seat. Engagement of the ball with the seat typically causes an increase in differential pressure which in turn actuates the downhole tool. The tool may be deactuated by increasing the pressure beyond a predetermined threshold such that the ball is urged through the seat. While such shear pin and ball drop mechanisms are also commercially serviceable, they are generally one-time or one-cycle mechanisms and do not typically allow for repeated actuation and deactuation of a downhole tool. Moreover, ball drop mechanisms generally require that the drill string have an unobstructed through bore extending from the surface to the ball seat. As such, ball drop mechanisms are not typically suitable for near bit tool deployments (e.g., tool deployments that are below measurement while drilling "MWD" and logging while drilling "LWD" tools).

There remains a need in the art for a hydraulic actuation assembly that enables a downhole tool, such as an underreamer or a stabilizer, to be actuated and deactuated substantially any number of times during a drilling operation without breaking the tool string and/or tripping the tool out of the borehole.

SUMMARY

A downhole tool including a pressure activated flow switch is disclosed. One or more disclosed tool embodiments include a block assembly (e.g., a reaming block) deployed in an axial recess of a tool body. The block assembly is configured to translate between radially retracted and radially extended positions in response to differential pressure. The flow switch is deployed external to the flow bore in an annular region between the tool body and a tool mandrel. The flow switch includes a flow piston configured to reciprocate between axially opposed open and closed positions in the annular region such that the block assembly is radially extended when the flow piston is in the open position and radially retracted when the flow piston is in the closed position. The flow piston is configured to translate from the closed position to the open position when a differential pressure between the flow bore of the downhole tool and a chamber of the downhole tool exceeds a predetermined threshold. The flow piston may be further configured to remain in the open position at differential pressures less than the threshold.

The disclosed embodiments may provide one or more technical advantages. For example, in the disclosed embodiments the flow switch is deployed entirely external to the central flow bore of the downhole tool. Such deployment tends to advantageously preserve the cross sectional area of the flow bore thereby providing no obstruction to drilling fluid flowing towards the drill bit. This acts to minimize both the pressure drop through the tool and erosion of internal tool components during use. Moreover, external deployment of the flow switch enables the downhole tool to be deployed low in the BHA (e.g., just above the drill bit).

The disclosed embodiments further enable a downhole tool to be selectively and repeatedly actuated and deactuated substantially any number of times without breaking the drill string and/or or tripping the tool out of the borehole. The disclosed embodiments further obviate the need for physical actuation and deactuation (e.g., including the use of darts, ball drops, and the like).

One or more embodiments of the invention may further make use of upper and lower thresholds thereby enabling the downhole tool to remain either actuated or deactuated over a wide range of operating pressures. This feature of the disclosed embodiments may enhance operational certainty as it tends to eliminate inadvertent actuation and deactuation.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Figure 1:
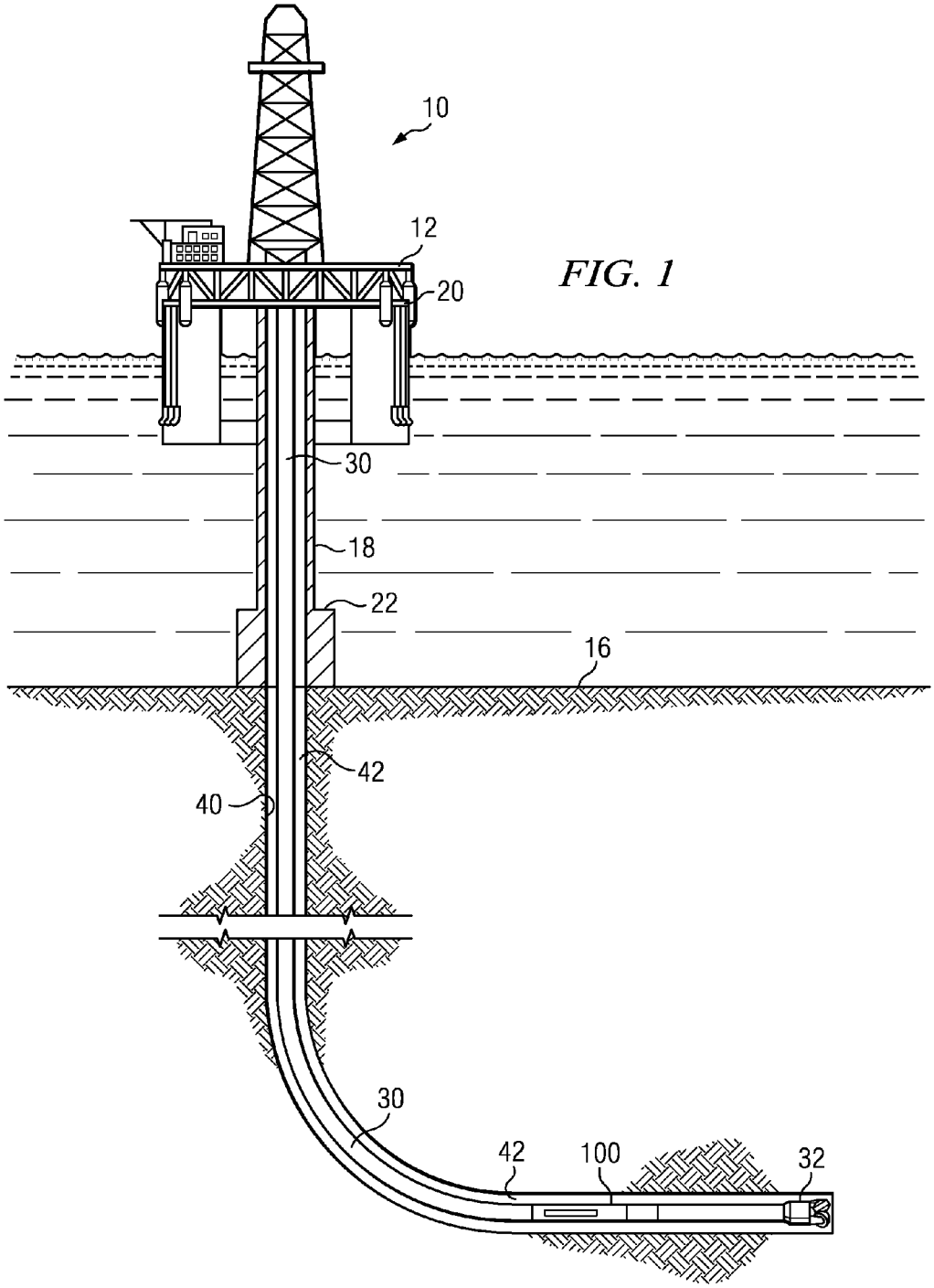
FIG. 1 depicts one example of how a downhole tool employing a pressure activated flow switch may be utilized in a conventional drilling rig.

FIG. 1 depicts one example of an offshore drilling assembly, generally denoted 10, on which a downhole tool employing a disclosed pressure activated flow switch may be used. A semisubmersible drilling platform 12 is positioned over an oil or gas formation disposed below the sea floor 16. A subsea conduit 18 extends from deck 20 of platform 12 to a wellhead installation 22. The platform may include a derrick and a hoisting apparatus for raising and lowering the drill string 30, which, as shown, extends into borehole 40 and includes drill bit 32 and an actuatable downhole tool such as underreamer 100 deployed above the bit 32. The drill string 30 may optionally further include substantially any number of other downhole tools including, for example, measurement while drilling (MWD) or logging while drilling (LWD) tools, stabilizers, a drilling jar, a rotary steerable tool, and/or a downhole drilling motor. The underreamer 100 may be deployed at substantially any location along the string, for example, just above the bit 32 or further uphole above various MWD and LWD tools.

During a typical drilling operation, drilling fluid (commonly referred to as "mud" in the art) is pumped downward through the drill string 30 and the bottom hole assembly (BHA) where it emerges at or near the drill bit 32 at the bottom of the borehole 40. The mud serves several purposes, for example, including cooling and lubricating the drill bit, clearing cuttings away from the drill bit and transporting them to the surface, and stabilizing and sealing the formation(s) through which the borehole 40 traverses. The discharged mud, along with the borehole cuttings and sometimes other borehole fluids, then flow upwards through the borehole annulus 42 (the space between the drill string 30 and the borehole wall) to the surface. In the disclosed exemplary embodiments, the downhole tool uses differential pressure, e.g., between an internal flow channel and the annulus, to selectively actuate and deactuate certain tool functionality (e.g., the radial extension of a cutting structure or a stabilizer blade outward from a tool body).

It will be understood by those of ordinary skill in the art that the deployment illustrated on FIG. 1 is merely an example. It will be further understood that the disclosed embodiments are not limited to use with a semisubmersible platform as illustrated on FIG. 1. The disclosed embodiments are equally well suited for use with any kind of subterranean drilling operation, either offshore or onshore.

Figure 2A:
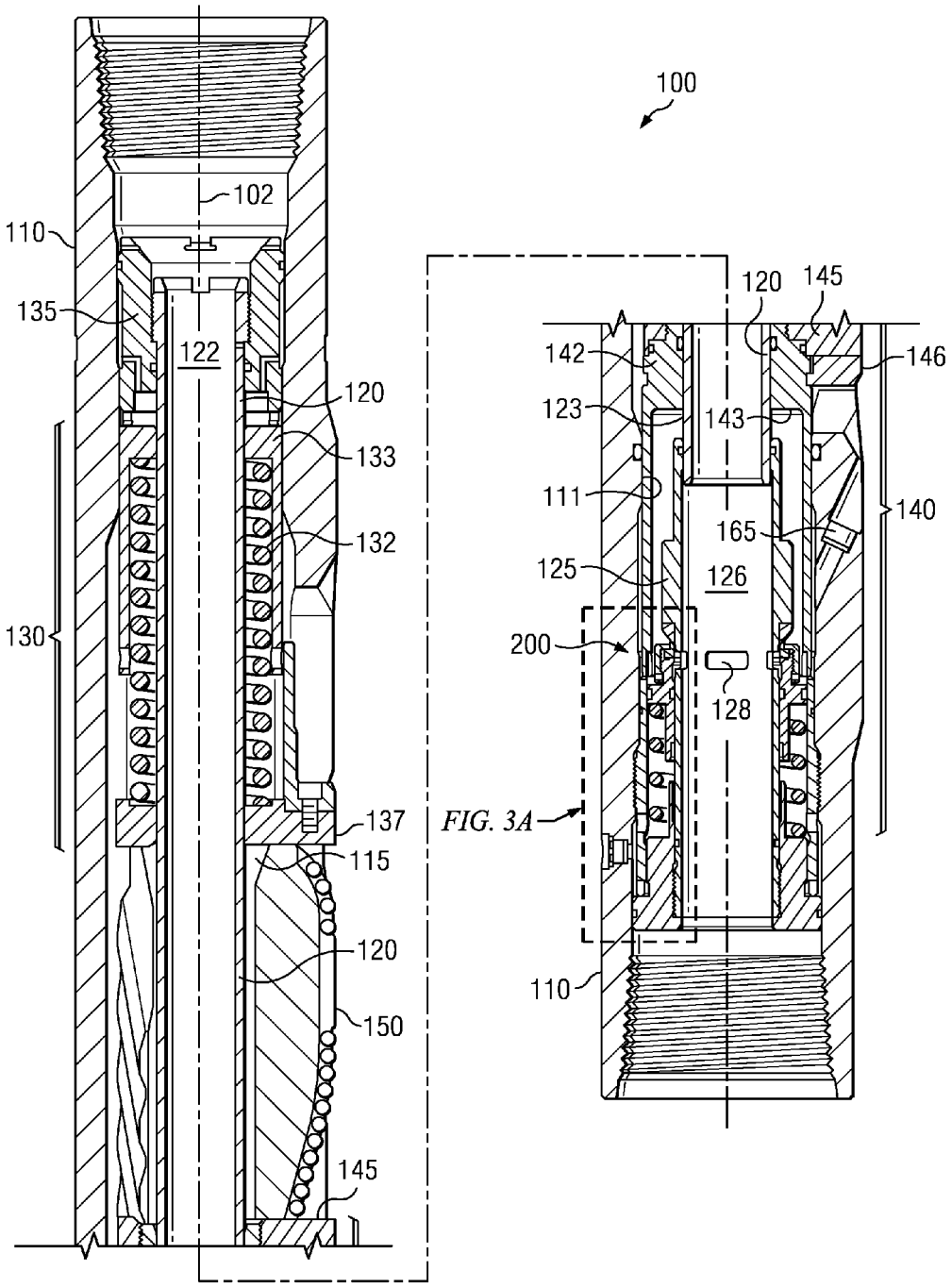
FIGS. 2A and 2B (collectively FIG. 2) depict longitudinal cross sectional views of a disclosed underreamer in retracted (FIG. 2A) and extended (FIG. 2B) configurations.
Figure 2B:
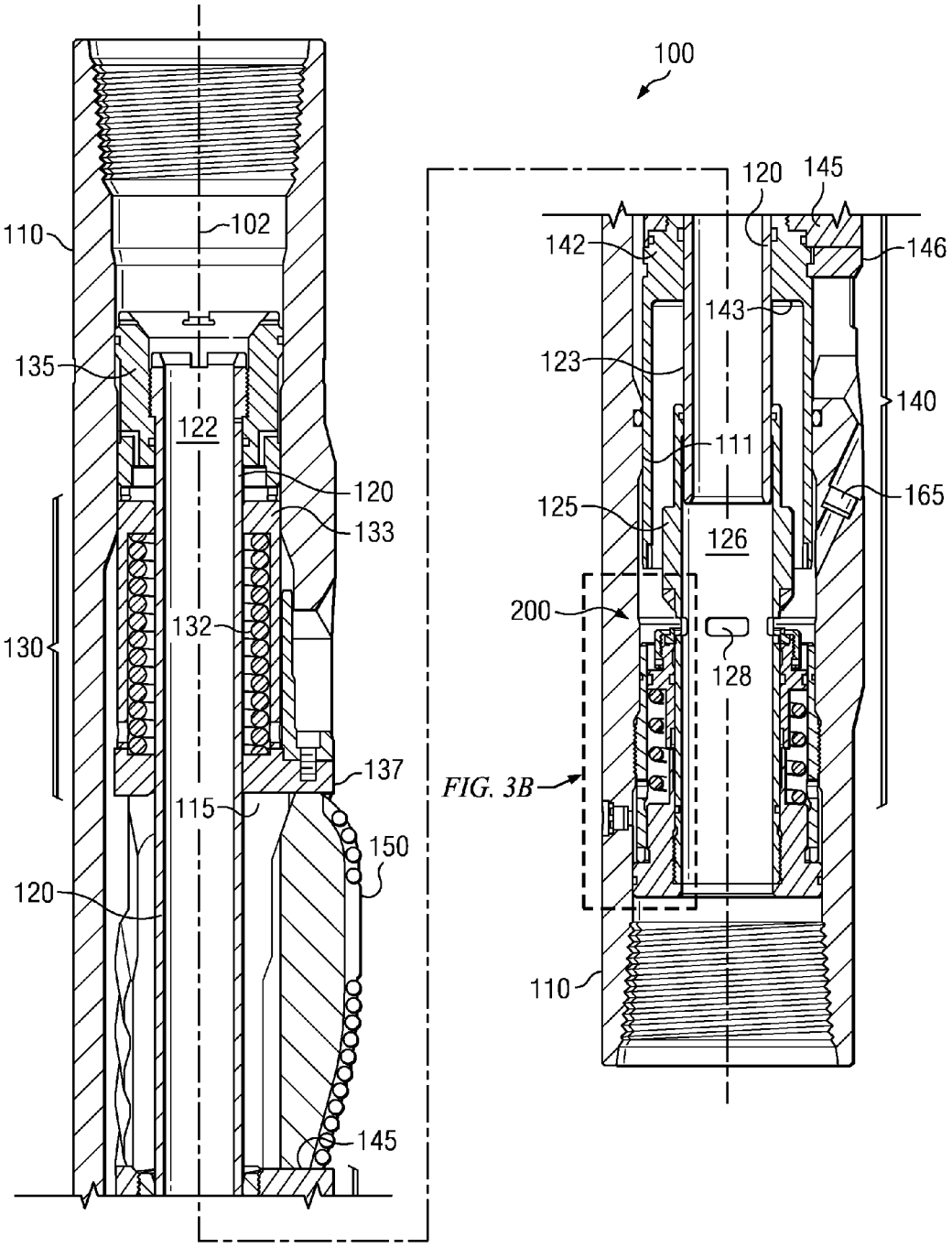

FIGS. 2A and 2B depict longitudinal cross sectional views of an underreamer 100 including a pressure activated flow switch 200. In FIG. 2A the underreamer 100 is depicted in a collapsed configuration in which the reaming block 150 is fully retracted into the tool body 110. In FIG. 2B the underreamer 100 is depicted in an expanded configuration in which the reaming block 150 is fully extended radially outward from the tool body 110. The reaming block 150 is deployed in a corresponding axial recess 115 in the tool body 110 and is disposed to reciprocate between the radially retracted and radially extended positions depicted on FIGS. 2A and 2B. While underreamer 100 is described with respect to a single reaming block 150, it will be understood that the disclosed embodiments are not limited in regard to the number of reaming blocks. Embodiments of underreamer 100 may include substantially any number of reaming blocks (e.g., three).

In one or more of the disclosed embodiments, the reaming block 150 includes a plurality of splines (not shown) on the lateral sides thereof. The splines are sized and shaped to engage corresponding splines (not shown) on the lateral tool body sides of the recess 115. Interconnection between these sets of splines may advantageously increase the surface area of contact between the reaming block 150 and the tool body 110 thereby providing a robust structure suitable for downhole operations (e.g., downhole reaming or stabilizing operations). The splines are angled such that they are non-parallel with respect to a longitudinal axis 102 of the underreamer 100. Thus, relative axial motion between the reaming block 150 and the tool body 110 causes a corresponding radial extension or retraction of the reaming block 150. In the depicted embodiment the splines are angled such that the reaming block 150 is radially extended via uphole axial motion thereof with respect to the tool body 110, although the disclosed embodiments are not limited in regard to the spline configuration. Commonly assigned U.S. Pat. No. 6,732,817, which is incorporated by reference in its entirety herein, discloses suitable reaming block configurations.

The radially facing outer surface (also referred to in the art as the gauge surface) of the reaming block 150 may optionally be fitted with various cutting elements. Substantially any cutting elements suitable for downhole reaming operations may be utilized, for example, including polycrystalline diamond cutter (PDC) inserts, thermally stabilized polycrystalline (TSP) inserts, diamond inserts, boron nitride inserts, abrasive materials, and the like. The reaming block 150 may alternatively or additionally include various wear protection measures deployed thereon, for example, including the use of wear buttons, hardfacing materials, or various other wear resistant coatings. The reaming block 150 may also include wear resistant stabilizer pads. It will be understood that the disclosed embodiments are not limited to any particular cutting element configuration or wear protection measures.

Extension and retraction of the reaming block 150 is now described in more detail. In the depicted embodiment, the reaming block 150 is deployed axially between spring biasing 130 and hydraulic actuation 140 mechanisms that are in turn deployed in the tool body 110. An internal mandrel 120 is deployed in the tool body 110 internal to the spring biasing mechanism 130 and the reaming block 150. The mandrel 120 includes a central through bore 122 that provides a channel for the flow of drilling fluid through the tool 100. The depicted spring biasing mechanism 130 includes a compression spring 132 deployed about the mandrel 120 in a spring retainer 133 and axially between an upper cap 135 and a stop ring 137. The upper cap is rigidly connected with the tool body 110 such that the compression spring 132 is configured to bias the reaming block 150 in the downhole direction. The spring bias also urges the reaming block 150 radially inward (due to the configuration of the angled splines described above).

The hydraulic actuation mechanism 140 is configured to urge the reaming block 150 in the uphole direction against the spring bias when a differential pressure between a chamber of tool 100 and the bore 122 of tool 100 (i.e., pressure from the flow bore 122) is greater than a predetermined threshold. The depicted embodiment includes an axial piston 142 sealingly engaged with an inner surface 111 of the tool body 110 and an outer surface 123 of the mandrel 120. Differential pressure acts on an axial face 143 of the piston 142 when flow switch 200 is open thereby urging the piston 142 in the uphole direction. The piston engages drive ring 145 and retainer 146 which in turn engages the reaming block 150 such that translation of the piston 142 causes a corresponding translation and extension of the reaming block 150, as best shown in FIG. 2B.

Figure 3A:
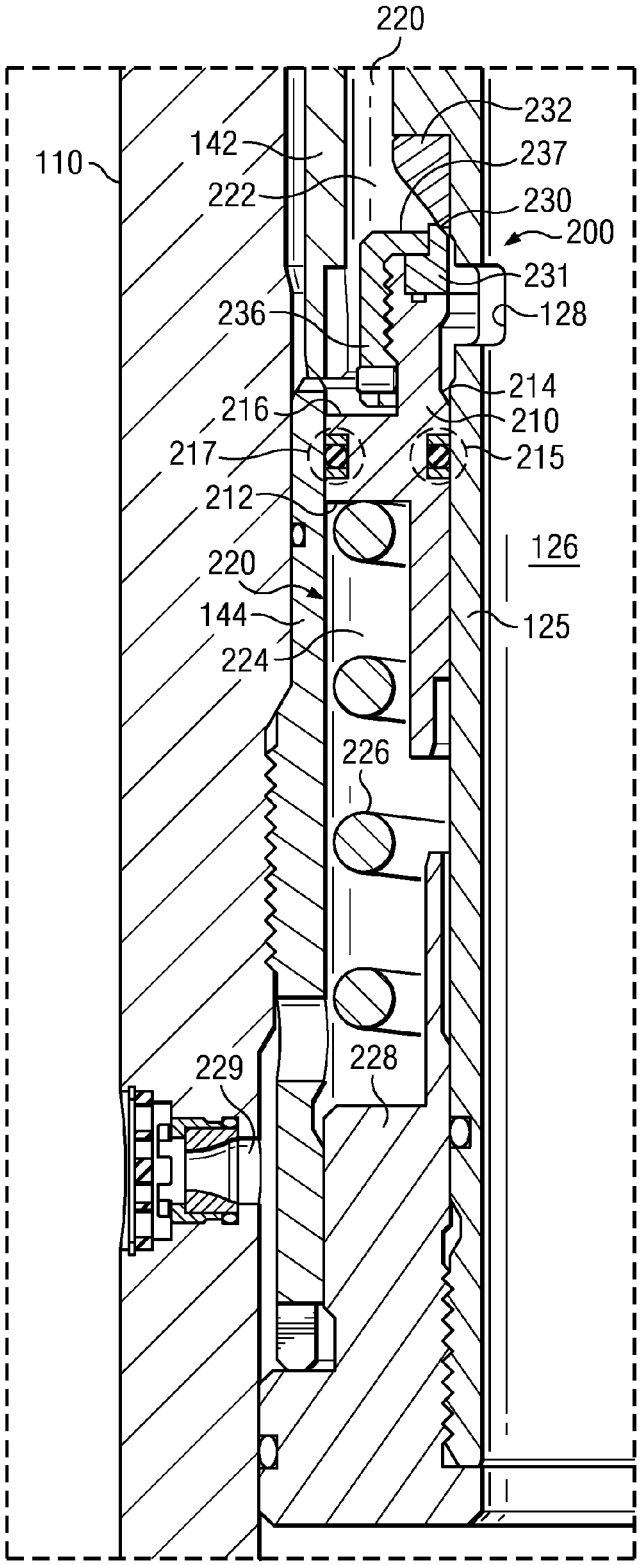
FIGS. 3A and 3B (collectively FIG. 3) depict detailed views of a flow switch embodiment of the underreamer shown on FIGS. 2A and 2B, respectively.
Figure 3B:
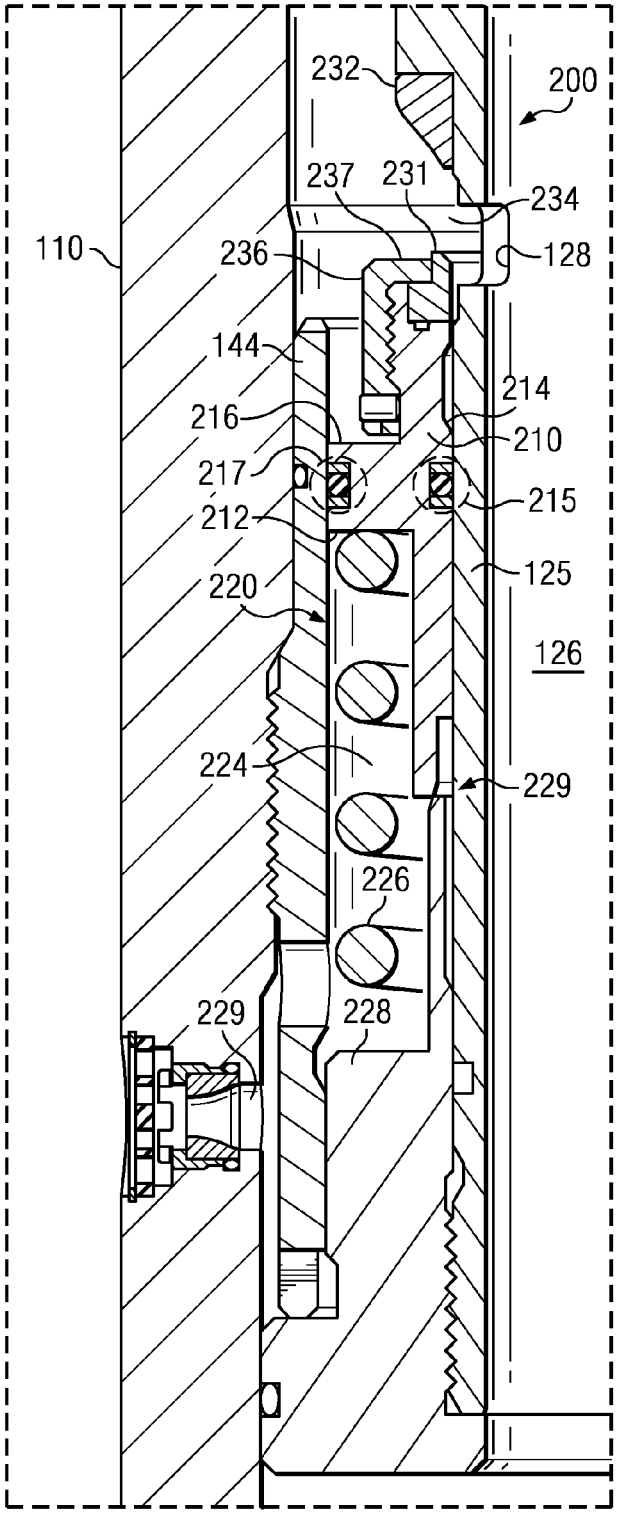

A flow switch embodiment 200 is now described in more detail with respect to FIGS. 3A and 3B. Flow switch 200 includes a flow piston 210 deployed in an annular chamber 220 located between a lower mandrel 125 at the inner diameter and axial piston 142 and lower cap 144 at the outer diameter. The flow piston 210 is sealingly engaged with an outer surface of the lower mandrel 125 via at least a first (inner) sealing member/element, e.g., a seal, 215 and an inner surface of the lower cap 144 via at least a second (outer) sealing member/element, e.g., a seal, 217 and thus divides the annular chamber into first and second upper and lower chambers 222 and 224. The flow piston 210 is arranged and designed to reciprocate axially between first and second closed and open positions. Lower chamber 224 is vented at 229 through the tool body 110 to the borehole annulus 42 (FIG. 1) to provide pressure equalization between the lower chamber 224 and the borehole annulus 42 (FIG. 1). Substantially any suitable vent, jet or port may be utilized.

A compression spring 226 is deployed in the lower chamber 224 between an end cap 228 and a shoulder portion 212 of the flow piston 210. The spring 226 is configured to bias the flow piston 210 in the uphole direction towards the first position such that sleeve 231 engages seat 232 thereby creating a solid contact seal 230. The solid contact seal 230 closes a flow channel 234 (FIG. 3B) between a central flow bore 126 of the lower mandrel 125 and the upper chamber 222. In the depicted embodiment, a retaining ring 236 secures the sleeve 231 to an uphole end of the flow piston 210. While the disclosed embodiments are not limited in this regard, the sleeve 231 and seat 232 may be fabricated from a hard, wear resistant material such as tungsten carbide to prevent wear and/or erosion thereof during service.

Flow switch 200 is configured to open flow channel 234 (FIG. 3B) when a differential pressure between bore 126 and chamber 224 exceeds a predetermined upper threshold (e.g., via increased flow rate through bore 126). At least one radial port 128 (four in the depicted embodiment) in lower mandrel 125 provides fluid communication between the bore 126 and the flow piston 210. When the flow piston 210 is in the closed position (FIG. 3A), bore 126 is in fluid communication with seal 215 (near face 214) and solid contact seal 230. The solid contact seal 230 has a diameter that is slightly larger than the diameter of seal 215. Owing to the difference in seal area between solid contact seal 230 and seal 215 (such seal area between solid contact seal 230 and seal 215 being defined as the inner seal area), a differential pressure between bore 126 and lower chamber 224 provides a force that acts on the inner seal area to oppose the bias of spring 226. The flow piston 210 remains in the closed position until the differential pressure exceeds the predetermined upper threshold at which point the fluid force begins to overcome the spring force. The predetermined upper threshold is influenced by the configuration of spring 226 and the difference in seal area between the solid contact seal 230 and seal 215. This difference in seal area is about one square inch in the depicted embodiment.

When the differential pressure between bore 126 and chamber 224 exceeds the predetermined upper threshold, the flow piston 210 begins to move in the downhole direction against the bias of the spring 226 and towards the second position. Movement of the flow piston 210 breaks the solid contact seal 230 and thereby begins to open flow channel 234, which allows drilling fluid to enter upper chamber 222 and act on face 216 of flow piston 210 and face 237 of retaining ring 236. High pressure drilling fluid in upper chamber 222 easily overcomes the biasing force of spring 226 (due to the fluid acting on the full annular seal area of the flow piston—i.e., the annular/upper chamber 222 area between seals 215 and 217). The flow piston 210 thus moves rapidly to the open position until it abuts end cap 228 as depicted at 229 in FIG. 3B.

Movement of the flow piston 210 to the open position provides full fluid communication between central bore 226 and upper chamber 222. As described above with respect to FIG. 2, fluid communication between central bore 126 and upper chamber 222 also enables the drilling fluid to act on piston 142, which causes the reaming block 150 to translate axially uphole and radially outward against the spring bias. In the depicted embodiment, drilling fluid is also routed to fluid jets 165 where it is vented from the tool so as to lubricate and cool the reaming block during a reaming operation.

Figure 4:
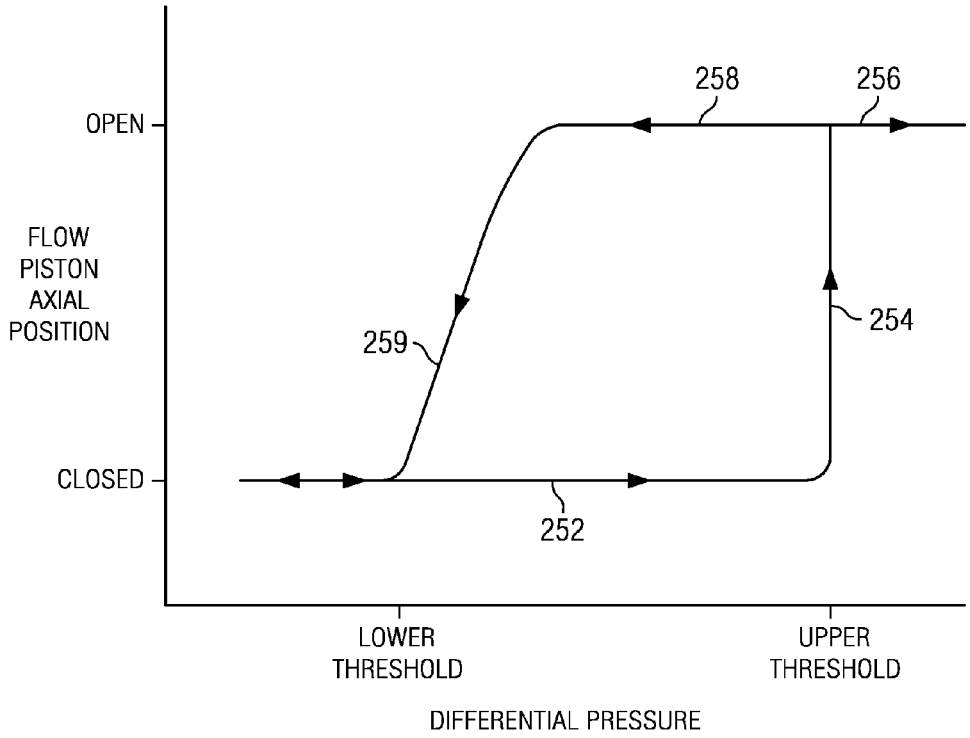
FIG. 4 depicts a plot of the flow piston axial position as a function of the differential pressure in the underreamer embodiment shown on FIG. 2.

FIG. 4 depicts a plot of the axial position of the flow piston 210 versus differential pressure between bore 126 and lower chamber 224 (i.e., the effect of fluid flow rate through bore 126) for the flow switch depicted on FIGS. 3A and 3B. As the flow rate increases at 252, the flow piston 210 (FIG. 3A) remains in the first closed position under the bias of spring 226 with sleeve 231 engaging seat 232. When the differential pressure reaches the upper threshold, the flow piston 210 (FIG. 3B) translates 254 in the downhole direction to the second open position where it contacts the end cap 228 as described above. The pressure may be increased above the upper threshold without further translating the flow piston 210 as indicated at 256. Since the annular seal area (i.e., upper chamber 222 between seals 215, 217) of the flow piston 210 is greater than the difference in seal area between the solid contact seal 230 and seal 215 (i.e., inner seal area), the flow piston 210 remains in the open position when the pressure is lowered below the upper threshold at 258. When the pressure reaches a lower threshold the flow piston translates 259 in the downhole direction to the closed position such that the sleeve 231 engages seat 232.

It will be understood that the upper threshold is related to the configuration of spring 226 (e.g., the spring force) and the difference in seal area between the solid contact seal 230 and seal 215, while the lower threshold is related to the configuration of spring 226 and the annular seal area of the flow piston 210. In the depicted embodiment, the difference in seal area between the solid contact seal 230 and seal 215 is about one square inch while the annular seal area of the flow piston 210 is about 14 square inches, thereby resulting in an upper threshold to lower threshold ratio of about 14. While the disclosed embodiments are of course not limited in this regard, it may be advantageous in certain applications to configure the downhole tool such that it has an upper threshold to lower threshold ratio in the range from about 5 to about 25. Ratios greater than about 5 tend to advantageously provide a wide differential pressure (or bore flow rate) window in which the flow switch 200 (FIG. 3B) remains open as indicated at 258 in FIG. 4. Moreover, these ratios tend to provide a strong hydraulic force to the flow piston 210 ensuring that it remains open during reaming operations at pressures above the lower threshold. Ratios less than about 25 enable the difference in seal area between the solid contact seal 230 and seal 215 to remain sufficiently large for actuation of the flow piston 210 from the closed position to the open position.

With reference again to FIGS. 3A and 3B, the disclosed embodiments of pressure activated flow switch 200 are advantageously deployed external to the central flow bore 126. No component of the flow switch 200 is deployed in the central flow bore 126. In the depicted embodiments, the flow switch 200, including the flow piston 210, the compression spring 226, the ring member 236, and the seat member 232 are deployed in the annular region 220 between the tool body 110 and the lower mandrel 125. The disclosed flow switch configuration thus advantageously preserves the cross sectional area of the flow bore thereby providing no obstruction (or diameter shrinkage) for drilling fluid flowing towards the drill bit.

While one or more embodiments of the pressure activated flow switch are described with respect to underreamer embodiments depicted on FIGS. 2 and 3, it will be under that the disclosure is not so limited. The disclosed pressure activated flow switch may be utilized to actuate substantially any downhole tool for which repeated hydraulic actuation and deactuation may be advantageous. Such tools may include, for example, hydraulically actuated stabilizers, expanding milling and pipe cutting tools, packers, impact tools, and the like.

Although one or more pressure activated flow switch embodiments and their advantageous deployment in downhole drilling tools have been disclosed, it should be understood to those of ordinary skill in the art that various changes, substitutions, and alternations can be made herein without departing from the spirit and scope of the invention as defined by the appended claims.

What is claimed is:

1. A downhole tool comprising:

a substantially tubular downhole tool body including an axial recess;

a block assembly deployed in the axial recess and configured to translate between radially retracted and radially extended positions;

a mandrel deployed in the downhole tool body, the mandrel including a flow bore;

a flow switch deployed in an annular region between an outer surface of the mandrel and an inner surface of the tool body, the flow switch including a flow piston configured to reciprocate between axially opposed open and closed positions in the annular region, and no component of the flow switch being deployed in the flow bore; wherein the block assembly is radially extended when the flow piston is in the open position and radially retracted when the flow piston is in the closed position, a ring member deployed on the flow piston contacts a seat member deployed on the mandrel thereby forming a solid contact seal and closing a flow channel between the flow bore and the annular region when the flow piston is in the closed position. wherein the flow switch further comprises a spring member configured to bias the flow piston towards the closed position wherein:

the flow piston has first and second sealing elements;

a difference between an area of the solid contact seal and an area of the first sealing element defines an inner seal area; and the flow piston is sized and shaped so that differential pressure acting across the inner seal area generates a first force opposed to said spring bias when the flow switch is in the closed position.

2. The downhole tool of claim 1, wherein:

the first and second sealing elements together define an annular seal area of the flow piston;

the flow piston is sized and shaped so that differential pressure acting across the annular seal area of the flow piston generates a second force opposed to said spring bias when the solid contact seal is broken.

3. The downhole tool of claim 2, wherein the annular seal area of the flow piston is about 5 to about 25 times greater than the inner seal area.

4. A flow switch for diverting fluids from a flow bore of a downhole tool, the flow bore including a port providing fluid communication between the flow bore and a device to be activated, the flow switch comprising:

a flow piston deployed external to the flow bore and in fluid communication with the port, the flow piston configured to reciprocate between axially opposed open and closed positions, the flow piston hydraulically isolating the flow bore from the device when in the closed position;

the flow piston including first and second sealing elements, the first sealing element sized and shaped to convert a differential pressure between the flow bore and an annular chamber to a first force urging the flow piston towards the open position;

a spring member deployed around a mandrel defining the flow bore and external to the flow bore, the spring member disposed to bias the flow piston towards the closed position; and wherein the flow piston is configured to translate from the closed position to the open position when the differential pressure exceeds a predetermined upper threshold wherein a ring member deployed on the flow piston contacts a seat member thereby forming a solid contact seal and closing a flow channel between the flow bore and the device when the flow piston is in the closed position wherein a difference between an area of the solid contact seal and an area of the first sealing element defines an inner seal area and differential pressure acting on the inner seal area generates the first force.

5. The flow switch of claim 4, wherein the first and second sealing elements together define an annular seal area of the flow piston and the flow piston is sized and shaped so that differential pressure acting across the annular seal area of the flow piston generates a second force urging the flow piston towards the open position after the solid contact seal is broken.

6. The flow switch of claim 5, wherein the annular seal area of the flow piston is about 5 to about 25 times greater than the first seal area.

* * * * *